US011019979B2

(12) United States Patent
Persson et al.

(10) Patent No.: US 11,019,979 B2
(45) Date of Patent: Jun. 1, 2021

(54) PROCESS WATER FLOW DETECTION IN CIRCULATION PUMP

(71) Applicant: ELECTROLUX APPLIANCES AKTIEBOLAG, Stockholm (SE)

(72) Inventors: David Persson, Stockholm (SE); Arne Nensén, Stockholm (SE)

(73) Assignee: Electrolux Appliances Aktiebolag (SE)

( * ) Notice: Subject to any disclaimer, the term of this patent is extended or adjusted under 35 U.S.C. 154(b) by 117 days.

(21) Appl. No.: 16/071,273

(22) PCT Filed: Feb. 15, 2016

(86) PCT No.: PCT/EP2016/053132
§ 371 (c)(1),
(2) Date: Jul. 19, 2018

(87) PCT Pub. No.: WO2017/140335
PCT Pub. Date: Aug. 24, 2017

(65) Prior Publication Data
US 2019/0174989 A1 Jun. 13, 2019

(51) Int. Cl.
*A47L 15/00* (2006.01)
*A47L 15/42* (2006.01)
(Continued)

(52) U.S. Cl.
CPC ..... *A47L 15/0049* (2013.01); *A47L 15/4244* (2013.01); *D06F 33/00* (2013.01);
(Continued)

(58) Field of Classification Search
CPC ..... A47L 15/0049; A47L 15/4244; A47L 2401/08; A47L 2501/01; A47L 2501/03;
(Continued)

(56) References Cited

U.S. PATENT DOCUMENTS 4,097,307 A 6/1978 Geiger
5,284,523 A 2/1994 Badami et al.
(Continued)

FOREIGN PATENT DOCUMENTS

CN 1 567 109 A 1/2005
CN 1909822 A 2/2007
(Continued)

OTHER PUBLICATIONS

Notice of Allowance for U.S. Appl. No. 14/438,351 dated Nov. 15, 2018.
(Continued)

*Primary Examiner* — Douglas Lee
(74) *Attorney, Agent, or Firm* — RatnerPrestia

(57) ABSTRACT

Provided are a method of detecting a change in process water flow of a circulation pump in an appliance for washing and rinsing goods, and an appliance performing the method. An appliance for washing and rinsing goods may be provided including a circulation pump, a sensing arrangement arranged to measure a property indicating torque of the circulation pump, and a controller. The controller may be arranged to average a first set of values of the measured property, thereby creating a first average, average at least a further set of values of the measured property, thereby creating at least one further average, compare the first average with the at least one further average, and to detect change in process water flow of the circulation pump based on a difference between the first average and the at least one further average.

20 Claims, 11 Drawing Sheets

(51) Int. Cl.
*D06F 39/08* (2006.01)
*D06F 33/00* (2020.01)

(52) U.S. Cl.
CPC ..... *D06F 39/085* (2013.01); *A47L 2401/08* (2013.01); *A47L 2501/01* (2013.01); *A47L 2501/03* (2013.01); *D06F 2202/08* (2013.01); *D06F 2202/085* (2013.01); *D06F 2202/12* (2013.01)

(58) Field of Classification Search
CPC ..... D06F 2202/08; D06F 2202/085; D06F 2202/12; D06F 39/085; D06F 33/00; D06F 33/02
See application file for complete search history.

(56) References Cited

U.S. PATENT DOCUMENTS

| | | | | |
|---|---|---|---|---|
| 5,330,580 | A | 7/1994 | Whipple, III et al. | |
| 6,655,922 | B1 | 12/2003 | Flek | |
| 6,887,318 | B2 | 5/2005 | Bashark | |
| 7,064,514 | B2 | 6/2006 | Iwaji et al. | |
| 7,064,517 | B2 | 6/2006 | Kiuchi et al. | |
| 7,241,347 | B2 | 7/2007 | Elick et al. | |
| 7,776,159 | B2 | 8/2010 | Hooker et al. | |
| 7,789,968 | B2 | 9/2010 | Elick et al. | |
| 8,295,984 | B2 | 10/2012 | Heisele et al. | |
| 8,439,052 | B2 | 5/2013 | Klein | |
| 9,872,597 | B2 | 1/2018 | Pers et al. | |
| 2001/0017145 | A1 | 8/2001 | Rosenbauer et al. | |
| 2003/0034749 | A1 | 2/2003 | Zinke et al. | |
| 2004/0099287 | A1 | 5/2004 | Shin | |
| 2005/0005952 | A1 | 1/2005 | Bashark | |
| 2006/0162438 | A1 | 7/2006 | Schofield et al. | |
| 2006/0219262 | A1* | 10/2006 | Peterson | A47L 15/4244 134/18 |
| 2006/0237048 | A1 | 10/2006 | Weaver et al. | |
| 2007/0151579 | A1 | 7/2007 | Hooker et al. | |
| 2007/0163626 | A1 | 7/2007 | Klein | |
| 2007/0181156 | A1 | 8/2007 | Uz et al. | |
| 2010/0139698 | A1* | 6/2010 | Gnadinger | A47L 15/0052 134/25.2 |
| 2010/0275953 | A1 | 11/2010 | Orue Orue et al. | |
| 2011/0038736 | A1 | 2/2011 | Hesterberg et al. | |
| 2011/0048459 | A1 | 3/2011 | Hesterberg et al. | |
| 2011/0126863 | A1 | 6/2011 | Kranzle et al. | |
| 2011/0286859 | A1 | 11/2011 | Ortiz et al. | |
| 2012/0000535 | A1 | 1/2012 | Poyner et al. | |
| 2012/0006355 | A1 | 1/2012 | Heidel et al. | |
| 2012/0048302 | A1 | 3/2012 | Didat | |
| 2012/0048314 | A1 | 3/2012 | Vitan et al. | |
| 2012/0060874 | A1 | 3/2012 | Gnadinger et al. | |
| 2012/0266919 | A1 | 10/2012 | Kranzle et al. | |
| 2013/0048025 | A1 | 2/2013 | Heidel et al. | |
| 2014/0334945 | A1 | 11/2014 | Koehl | |
| 2015/0305592 | A1 | 10/2015 | Pers et al. | |
| 2016/0002942 | A1 | 1/2016 | Orlando | |
| 2018/0283370 | A1 | 10/2018 | Slaby et al. | |

FOREIGN PATENT DOCUMENTS

| | | | | |
|---|---|---|---|---|
| CN | 104768441 | A | 7/2015 | |
| DE | 197 50 266 | A1 | 5/1999 | |
| DE | 10 2004 022 682 | B3 | 3/2006 | |
| DE | 10 2007 041 313 | A1 | 3/2009 | |
| DE | 10 2007 052 091 | A1 | 5/2009 | |
| DE | 10 2008 020 475 | A1 | 11/2009 | |
| DE | 10 2008 029 910 | A1 | 12/2009 | |
| DE | 10 2011 000 287 | A1 | 7/2012 | |
| DE | 10 2011 003 688 | A1 | 8/2012 | |
| DE | 10 2014 105527 | B3 | 4/2015 | |
| EP | 0 326 893 | A2 | 8/1989 | |
| EP | 1 112 016 | A1 | 7/2001 | |
| EP | 1 284 540 | A2 | 2/2003 | |
| EP | 1 574 161 | A1 | 9/2005 | |
| EP | 1574161 | A1 * | 9/2005 | A47L 15/4225 |
| EP | 1 737 332 | A1 | 1/2007 | |
| EP | 2 213 217 | A1 | 8/2010 | |
| EP | 2 248 935 | A1 | 11/2010 | |
| EP | 2 407 078 | A2 | 1/2012 | |
| EP | 2 609 845 | A1 | 7/2013 | |
| EP | 2 672 875 | A1 | 12/2013 | |
| JP | H02302239 | A | 12/1990 | |
| JP | H05 115414 | A | 5/1993 | |
| JP | H0819506 | A | 1/1996 | |
| JP | 2006 006 766 | A | 1/2006 | |
| JP | 2011 143 130 | | 7/2011 | |
| KR | 10-2012-0022427 | | 3/2012 | |
| WO | WO 2005/070275 | A1 | 8/2005 | |
| WO | WO 2005/089621 | A1 | 9/2005 | |
| WO | WO 2006/116433 | A1 | 11/2006 | |
| WO | WO 2008/125482 | A2 | 10/2008 | |
| WO | WO 2009/027371 | A1 | 3/2009 | |
| WO | WO 2009/068391 | A1 | 6/2009 | |
| WO | WO 2009/156326 | A2 | 12/2009 | |
| WO | WO 2012/107264 | A1 | 8/2012 | |
| WO | WO 2012/146599 | A2 | 11/2012 | |
| WO | WO 2014/005650 | A1 | 1/2014 | |
| WO | WO-2014071981 | A1 * | 5/2014 | A47L 15/4202 |
| WO | WO 2014/106801 | A1 | 7/2014 | |

OTHER PUBLICATIONS

Notice of Allowance for U.S. Appl. No. 15/772,214 dated Nov. 19, 2019.
Brushless DC electric motor—Wikipedia, the free encyclopedia [online] [retrieved Nov. 19, 2013]. Retrieved from the Internet: <URL: http://en.wikipedia.org/wiki/Brushless_DC_electric_motor>. 1 page.
EPO machine translation of WO2005070275 retrieved from https://worldwide.espacenet.com/publicationDetails/biblio?CC=WO&NR=2005070275A1&KC=A1&FT=D&ND=3&date=20050804&DB=&locale=en_EP on Nov. 28, 2016.
International Search Report and Written Opinion for Application No. PCT/EP2015/076184 dated Feb. 8, 2016, 13 pages.
International Search Report and Written Opinion for Application No. PCT/EP2015/077675 dated Aug. 16, 2016, 9 pages.
International Search Report and Written Opinion for International Application No. PCT/EP2012/072203, dated Sep. 6, 2013.
International Search Report and Written Opinion for International Application No. PCT/EP2012/072204, dated Sep. 6, 2013.
International Search Report and Written Opinion for International Application No. PCT/EP2016/053132 dated Nov. 9, 2016.
Notice of Allowance for U.S. Appl. No. 14/439,346 dated Sep. 20, 2017.
Office Action for Chinese Application No. 201280076924.9 dated Oct. 10, 2016.
Office Action for U.S. Appl. No. 14/439,346 dated Dec. 5, 2016.
Office Action for U.S. Appl. No. 14/439,351 dated Aug. 18, 2017.
Office Action for U.S. Appl. No. 14/439,351 dated May 16, 2018, 10 pages.
Office Action from corresponding European Patent Application No. 12805600.9 dated Feb. 10, 2017.
Office Action from corresponding European Patent Application No. 12805601.7 dated Sep. 23, 2016.
Office Action from U.S. Appl. No. 14/439,346 dated Aug. 31, 2016.
Office Action from U.S. Appl. No. 14/439,351 dated Apr. 21, 2017.

* cited by examiner

PROCESS WATER FLOW DETECTION IN CIRCULATION PUMP

CROSS-REFERENCE TO RELATED APPLICATIONS

This application is a national stage application filed under 35 U.S.C. § 371 of International Application No. PCT/EP2016/053132 filed Feb. 15, 2016, which application is hereby incorporated by reference in its entirety.

TECHNICAL FIELD

The invention relates to a method of detecting a change in process water flow of a circulation pump in an appliance for washing and rinsing goods, and an appliance performing the method.

BACKGROUND

In a washing appliance such as a dishwasher, sensors are required for monitoring water levels in a compartment of the dishwasher, in particular when supplying water to the compartment via a dishwasher inlet to avoid an overflow situation, or simply to just monitor the approximate water level in the dishwasher.

Further, even if determination of a water level may not be required, it may still be desirable to detect whether there is process water present in a circulation pump of a dishwasher. In order to determine the presence of process water in the pump in the art, sensors such as e.g. flow sensors, pressure sensors, pressure switches, float switches, etc. are necessary. These sensors add to the complexity, and thus the cost, of the dishwasher.

US 2006/219262 discloses a control device and method for detecting and controlling a water fill level in a dishwasher or other similar appliance that includes a pump motor. The control device monitors the pump motor current over time, determines a current change, and compares the current change to a threshold current change that is indicative of the water level.

During periods of pump cavitation, the current drawn by the pump motor is measurably lower, while the current drawn by the pump motor increases when the pump is not cavitating. The approach of US 2006/219262 avoids the usage of specialized sensors as discussed hereinabove.

However, by monitoring the pump current and determining a change in current I—i.e. a ΔI—as a difference between two instantaneous pump current values $I_{min}$ and $I_{max}$ in a cycle, fluctuations in pump current around a nominal value may result in an incorrect decision taken. For instance, if $\Delta I=I_{max}-I_{min}$ exceeds a predetermined threshold value $\Delta I_T$, it is concluded that more water should be supplied to the dishwasher, but this may be a result of a temporary fluctuation in pump current which do not indicate a need for activation of water fill.

SUMMARY

An object of the present invention is to solve, or at least mitigate, this problem in the art, and to provide an improved method of detecting a change in process water flow of a circulation pump in an appliance for washing and rinsing goods.

This object is attained in a first aspect of the invention by a method of detecting a change in process water flow of a circulation pump in an appliance for washing and rinsing goods. The method comprises measuring a property indicating torque of the circulation pump, averaging a first set of values of the measured property, thereby creating a first average, and averaging at least a further set of values of the measured property, thereby creating at least one further average. The method further comprises comparing the first average with the at least one further average, and detecting the change in process water flow of the circulation pump based on a difference between the first average and the at least one further average.

This object is attained in a second aspect of the invention by an appliance for washing and rinsing goods comprising a circulation pump, a sensing arrangement arranged to measure a property indicating torque of the circulation pump, and a controller. The controller is arranged to average a first set of values of the measured property, thereby creating a first average, average at least a further set of values of the measured property, thereby creating at least one further average, compare the first average with the at least one further average, and to detect change in process water flow of the circulation pump based on a difference between the first average and the at least one further average.

Advantageously, by averaging a first set of values of the property indicating torque of the circulation pump, which in an embodiment is circulation pump current indirectly representing pump torque, thereby creating a first average, and comparing the first average to at least one further average created from a further set of values, the effect of temporary fluctuations is eliminated.

Thus, in a scenario where the measured property, being e.g. pump current, fluctuates around a nominal value, but where an average of the fluctuating values equals (or is close to) the nominal value, a result of applying the proposed method is that it can be concluded that no change in process water flow of the circulation pump is detected. To the contrary, if there is a sufficient difference between the first average and the at least one further average, a change in process water flow of the pump is indeed detected, and a corresponding action may be taken accordingly, such as supplying water to the appliance in case the flow has decreased.

Further advantageous is that individual characteristics of the circulation pump of the appliance, being e.g. a dishwasher or a washing machine, can be eliminated. These characteristics include for instance particular model, production tolerances and change (e.g. demagnetization and/or wear) over time. By using average torque values rather than instant values, the effect of changes in characteristics may be eliminated, or at least mitigated.

In an embodiment, the comparing of the first average with the further average comprises calculating a difference between the first average and the at least one further average, and determining whether the difference complies with a predetermined threshold criterion. If so, it is concluded that the further average reflects a decrease in pump torque, and a decrease in process water flow of the circulation pump is advantageously detected. For instance, it may be determined whether a result of a subtraction of the further average from the first average exceeds a predetermined current threshold value.

In a further embodiment, the averaging of at least a further set of values of the measured property comprises averaging a plurality of sets of values of the measured property, thereby creating a corresponding plurality of averages. Subsequently, the first average is compared with each of the plurality of averages; and each of the comparisons must indicate change in flow for a flow change to indeed be detected.

For instance, each comparison may include calculating a difference between the first average and a respective one of the plurality of averages, and if each calculated difference exceeds a corresponding (or same) threshold value, a decrease in process water flow of the circulation pump is advantageously detected.

In yet an embodiment, the torque of the circulation pump is measured by measuring operating current of a motor driving the circulation pump. This may be measured indirectly by measuring the voltage of a known shunt resistor in the motor and calculating the current by applying Ohm's law. Measured current can be directly translated into circulation pump torque; the higher the torque, the higher the operating current of the motor driving the pump, and a higher pump torque implies a greater flow of process water through the circulation pump. Measuring operating current of the circulation pump motor is in itself advantageous as compared to using a relatively expensive flow rate sensor to measure the flow of process water through the circulation pump.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description. The washing appliance of the invention will subsequently be exemplified by a dishwasher.

Figure 1:
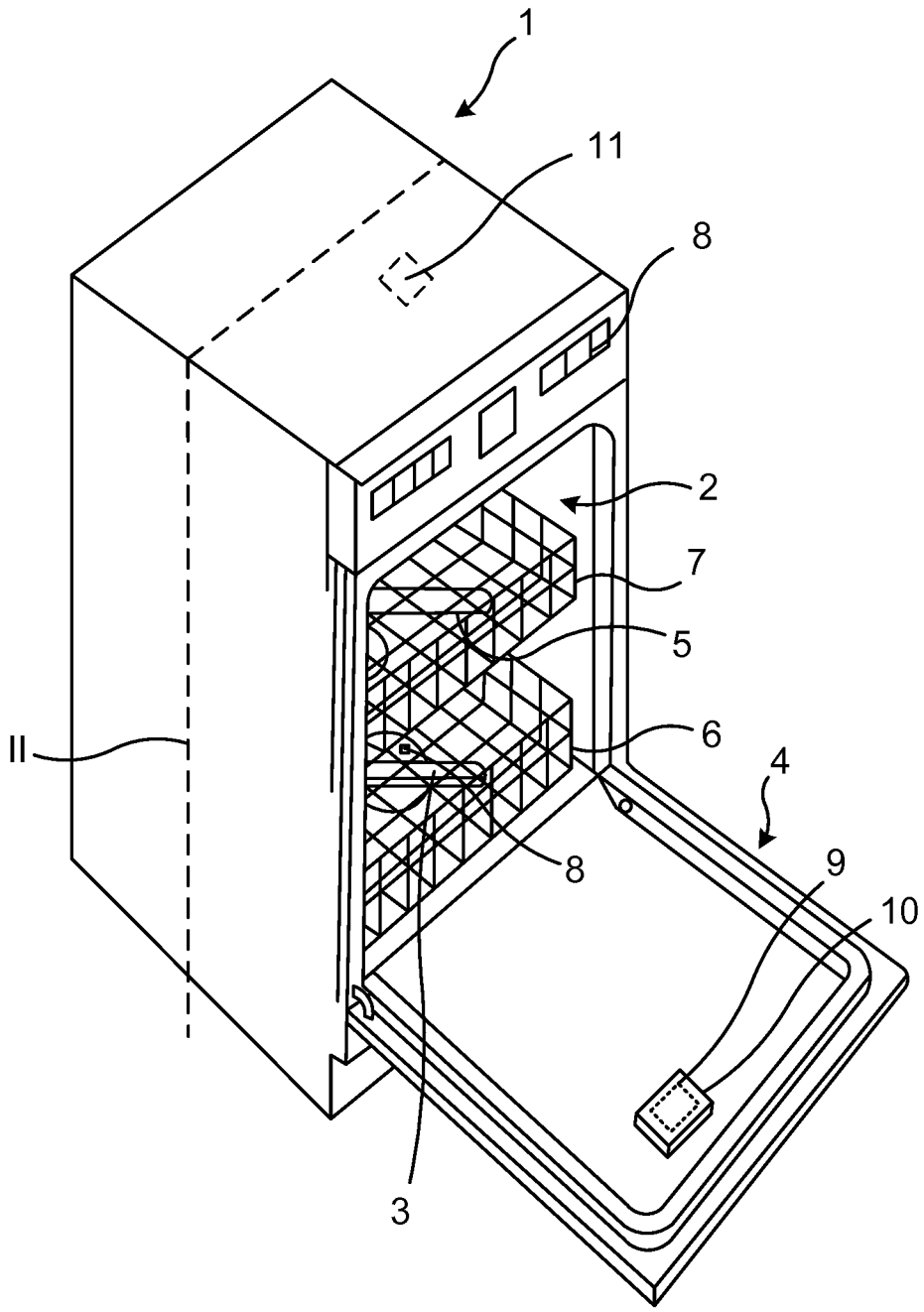
FIG. 1 shows a prior art dishwasher in which the present invention may be implemented.

FIG. 1 shows a prior art dishwasher 1 in which the present invention can be implemented. It should be noted that dishwashers can take on many forms and include many different functionalities. The dishwasher 1 illustrated in FIG. 1 is thus used to explain different embodiments of the present invention and should only be seen as an example of a dishwasher in which the present application can be applied.

The exemplifying dishwasher 1 comprises a washing compartment or tub 2, a door 4 configured to close and seal the washing compartment 2, a spraying system having a lower spray arm 3 and an upper spray arm 5, a lower rack 6 and an upper rack 7. Additionally, it may comprise a specific top rack for cutlery (not shown). A controller 11 such as a microprocessor is arranged in the interior of the dishwasher for controlling washing programmes and is communicatively connected to an interface 8 via which a user can select washing programmes.

The door 4 of the prior art dishwasher 1 illustrated in FIG. 1 is further on its inside arranged with a small detergent dispenser 9 having a lid 10 being controllably opened and closed by the controller 11 for dispensing detergent from the dispenser 9 into the tub 2.

Figure 2:
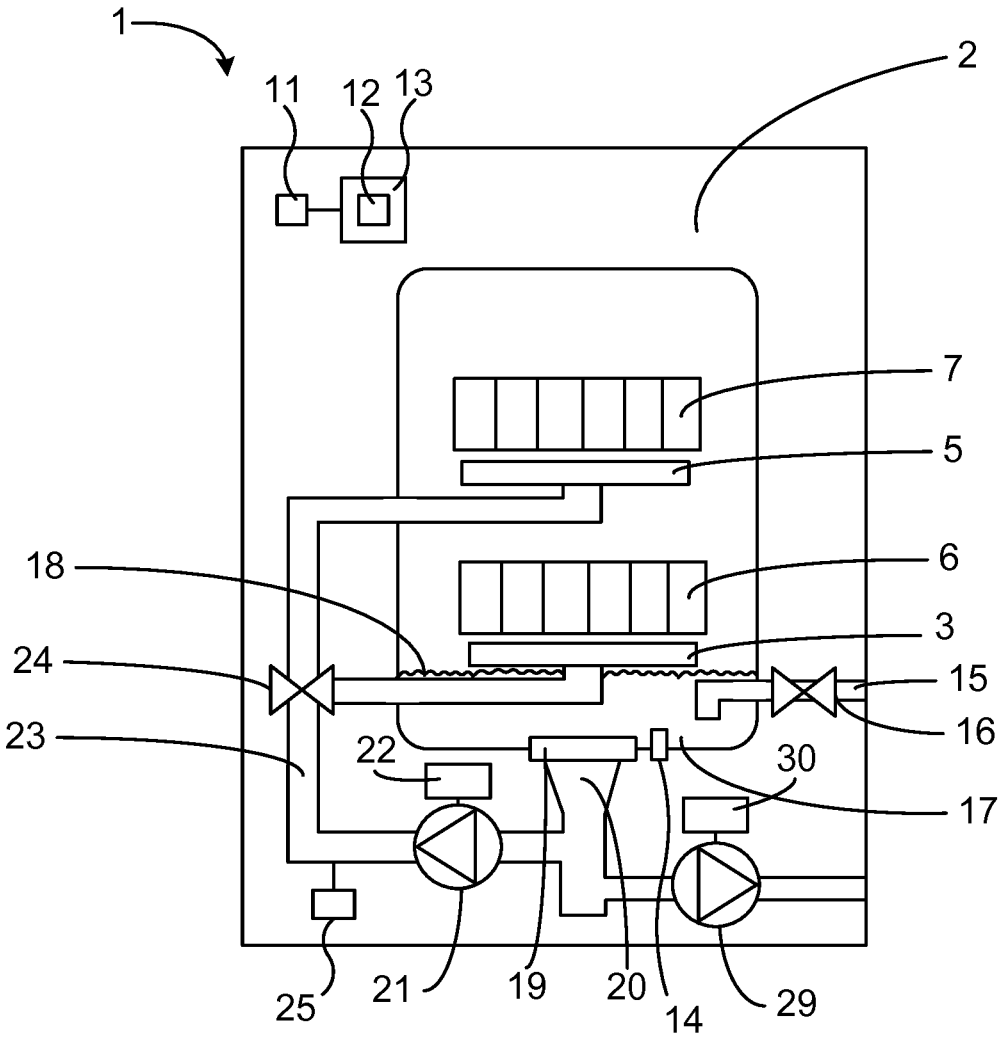
FIG. 2 schematically illustrates a cross-sectional view of the dishwasher of FIG. 1 taken along section II.

FIG. 2 schematically illustrates a cross-sectional view of the dishwasher 1 of FIG. 1 taken along section II, to further illustrate components included in a dishwasher 1. Hence, as previously mentioned, the dishwasher 1 comprises a washing compartment or tub 2 housing an upper basket 7 and a lower basket 6 for accommodating goods to be washed such as cutlery, plates, drinking-glasses, trays, etc.

Detergent in the form of liquid, powder or tablets is dosed in a detergent compartment located on the inside of a door (not shown in FIG. 2) of the dishwasher 1 by a user, which detergent is controllably discharged into the washing compartment 2 in accordance with a selected washing programme. As previously mentioned, the operation of the dishwasher 1 is typically controlled by the controller 11 executing appropriate software 12 stored in a memory 13.

Fresh water is supplied to the washing compartment 2 via water inlet 15 and water supply valve 16. This fresh water is eventually collected in a so called sump 17, where the fresh water is mixed with the discharged detergent resulting in process water 18. The opening and closing of the water supply vale 16 is typically controlled by the controller 11.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle. The pressurized fluid supplied to the detergent dispensing device according to embodiments of the invention thus at least partly contains process water.

At the bottom of the washing compartment is a filter 19 for filtering soil from the process water before the process water leaves the compartment via process water outlet 20 for subsequent re-entry into the washing compartment 2 through circulation pump 21. Thus, the process water 18 passes the filter 19 and is pumped through the circulation pump 21, which typically is driven by a brushless direct current (BLDC) motor 22, via a duct 23 and process water valve 24 and sprayed into the washing compartment 2 via nozzles (not shown) of a respective wash arm 3, 5 associated with each basket 6, 7. Thus, the process water 18 exits the washing compartment 2 via the filter 19 and is recirculated via the circulation pump 21 and sprayed onto the goods to be washed accommodated in the respective basket via nozzles of the wash arms 3, 5. Further, a controllable heater 14 is typically arranged in the sump 17 for heating the process water 18.

The washing compartment 2 of the dishwasher 1 is drained on process water 18 with a drain pump 29 driven by a BLDC motor 30. It should be noted that it can be envisaged that the drain pump 29 and the circulation pump 21 may be driven by one and the same motor.

In an embodiment of the invention, a sensing arrangement 25 is arranged at the circulation pump 21 for measuring torque of the circulation pump 21, in the form of e.g. operating current, voltage or power. The sensing arrangement 25 may be implemented in the form of a resistor arranged at the circulation pump motor 22 for measuring operation current of the motor. Practically, this is undertaken by measuring the operating voltage of a known shunt resistor in the motor 22 of the circulation pump 21 and calculating the operating current.

Measured pump operating current can directly be translated into circulation pump torque for a given circulation pump speed; the higher the torque, the higher the operating current of the motor 22 driving the pump 21, and a higher pump torque implies a greater flow of process water 18 through the circulation pump while a lower torque indicates a smaller flow of process water 18 through the circulation pump 21.

It should be noted that a torque sensor (not shown) may be used for directly measuring circulation pump torque instead of indirectly measuring the torque via an electrical property.

Figure 3A:
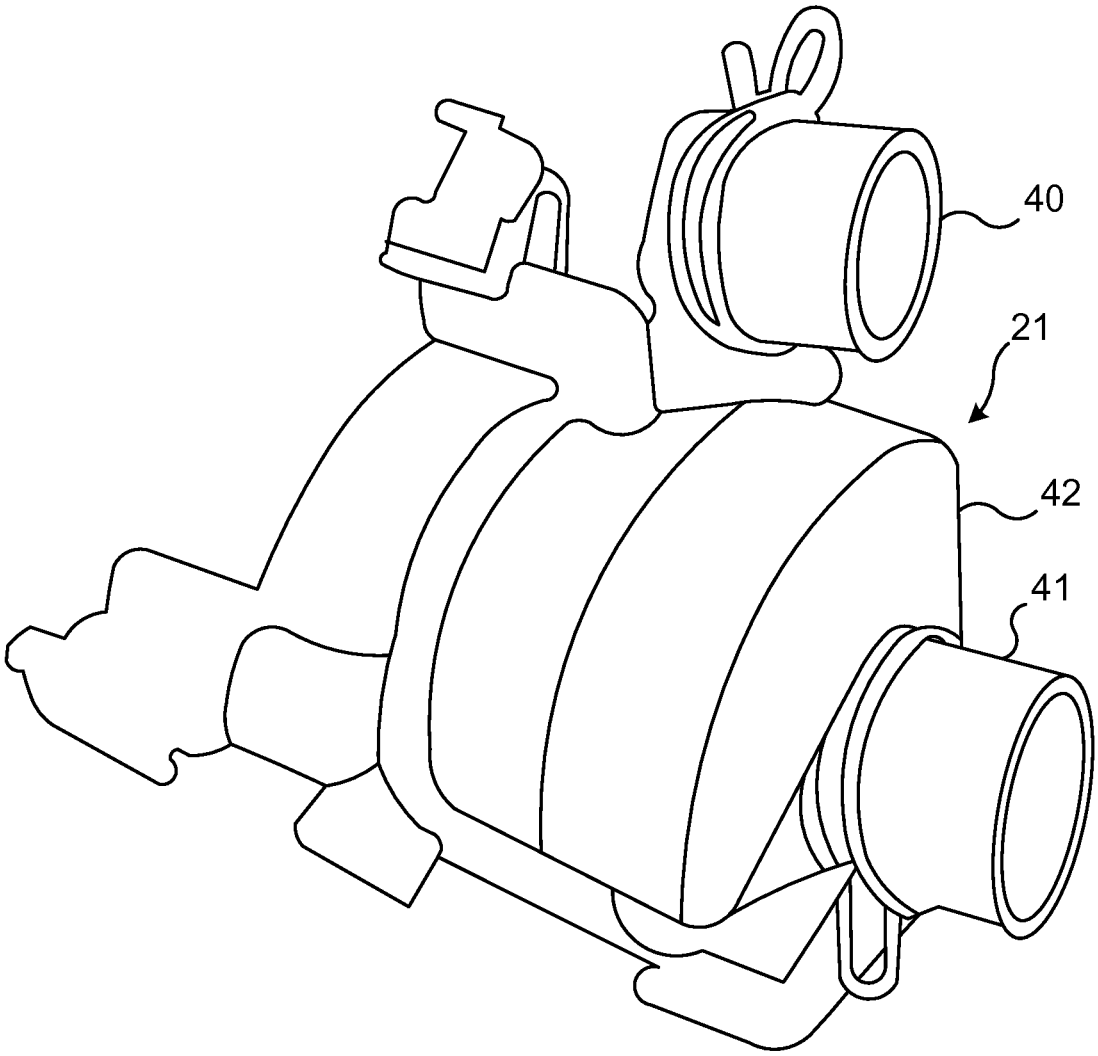
FIGS. 3*a* and *b* illustrate two different views of a circulation pump through which a change in process water flow may be determined according to embodiments of the invention.

FIG. 3*a* shows a view of an exemplifying circulation pump 21. The speed of the circulation pump 21 is typically controlled by the controller 11. FIG. 3*a* shows an outlet 40 (referred to as a discharge port) of the circulation pump 21 and an inlet 41. The casing 42 of the circulation pump 21 is referred to as the volute and can be removed from a main body 43 of the circulation pump 21.

Figure 3B:
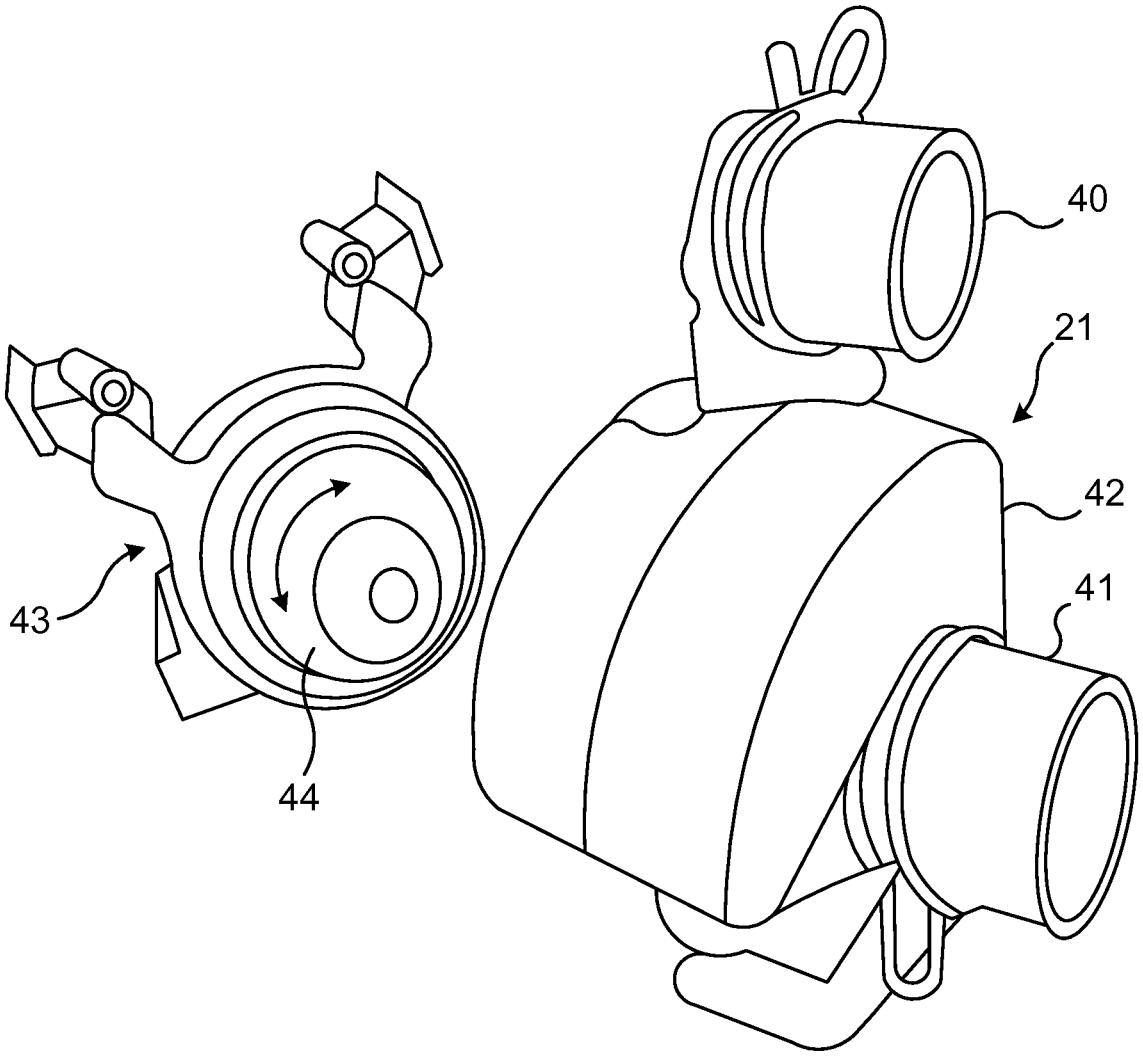

FIG. 3*b* shows a further view of the circulation pump 21 of FIG. 3*a*, where the volute 42 has been removed from the main body 43 of the circulation pump, thereby revealing the impeller 44 of the circulation pump which under operation pumps the process water that is entering the circulation pump 21 via the inlet 41. The process water that is pumped by the impeller 44 is subsequently received by the volute 42, which slows down the flow rate of the process water, and exits the circulation pump 21 via the outlet 40.

Figure 4:
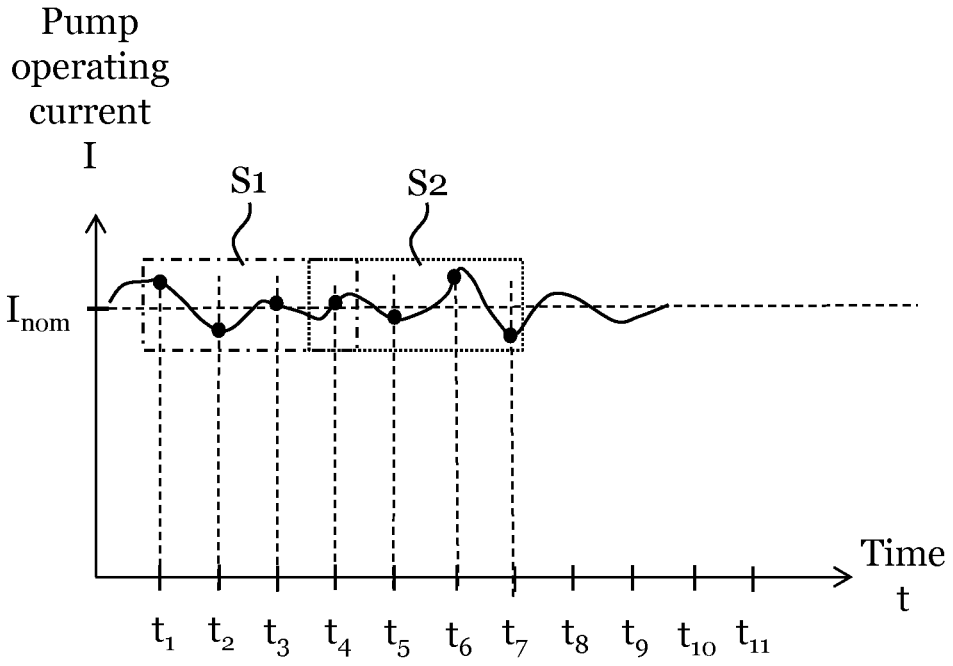
FIG. 4 illustrates fluctuations in circulation pump operating current over time.

FIG. 4 illustrates fluctuations in circulation pump operating current over time, i.e. the operating current being a property indicating torque of the circulation pump 21. As can be seen, the operating current fluctuates around a nominal pump operating current $I_{nom}$. FIG. 4 illustrates seven measured current values from $t_1$ to $t_7$. The measured current at each instant of time $t_n$ will be denoted $I(t_n)$.

With reference to the art, in case e.g. $\Delta I = I(t_1) - I(t_2)$ exceeds a predetermined threshold value $\Delta I_T$, it may be concluded that more water should be supplied to the dishwasher 1, since the torque of the circulation pump 21 is indicated to having decreased to a level $I(t_2)$ where a water fill is required. As will be described in the following with reference to FIG. 4, this may be a result of a temporary fluctuation in pump current which in fact do not indicate a need for activation of water fill.

Figure 5:
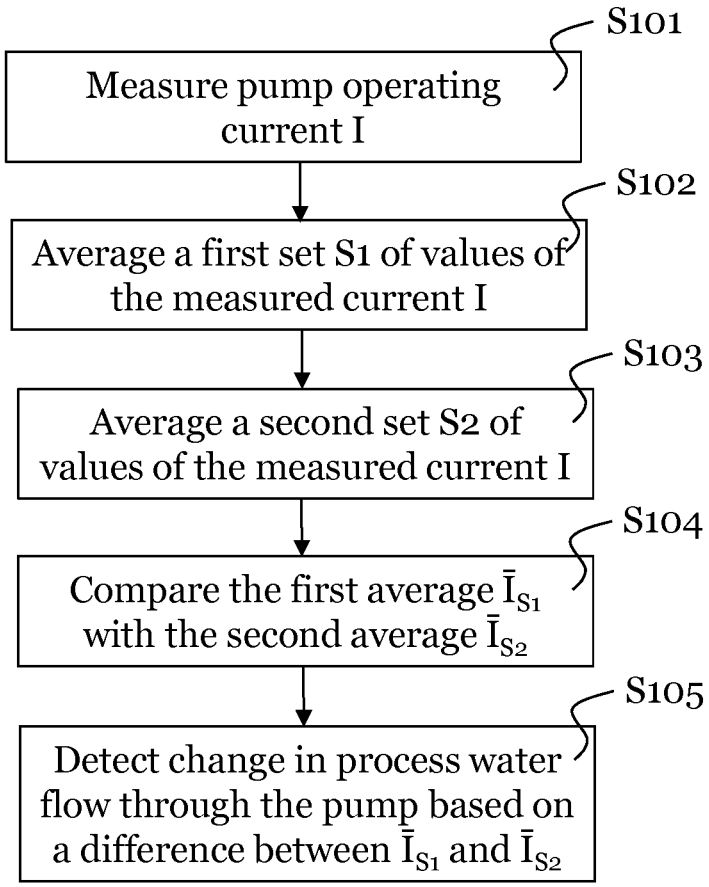
FIG. 5 shows a flowchart illustrating an embodiment of a method of detecting a change in process water flow of a circulation pump according to the invention.

In an embodiment of the present invention, where reference further will be made to the flowchart of FIG. 5, a property is measured indicating torque of the circulation pump 21 in step S101, in this case operating current of the pump.

In a second step S102, a first set S1 of measured current values is averaged, thereby creating a first average current value, $\bar{I}_{S1}$. This could be undertaken in different ways depending on the particular application, for instance by calculating an arithmetic mean or a moving average.

In this particular exemplifying embodiment, an arithmetic mean is calculated as:

$$\bar{I}_{S1} = \frac{I(t_1) + I(t_2) + I(t_3) + I(t_4)}{4}$$

In the illustration of FIG. 4, it can be concluded that $\bar{I}_{S1} \approx I_{nom}$.

In a third step S103, a second set S2 of measured current values is averaged, thereby creating a second average current value, $\bar{I}_{S2}$:

$$\bar{I}_{S2} = \frac{I(t_4) + I(t_5) + I(t_6) + I(t_7)}{4}$$

Again with reference to the illustration of FIG. 4, it can be concluded that $\bar{I}_{S2} \approx I_{nom}$.

In this example, the two sets S1 and S2 comprise one overlapping measured current value $I(t_4)$. It can be envisaged that further measured current values are common to the two sets S1 and S2, or that no overlap occurs at all.

In step S104, the first average current $\bar{I}_{S1}$ is compared to the second average current $\bar{I}_{S2}$, and from the comparison it is detected in step S105 whether a change in process water flow of the circulation pump 21 has occurred based on a difference between the first average $\bar{I}_{S1}$ and the second average $\bar{I}_{S2}$.

In this exemplifying embodiment, the first average current $\bar{I}_{S1}$ and the second average current $\bar{I}_{S2}$ are substantially equal, and accordingly no change in process water flow is detected.

Figure 6:
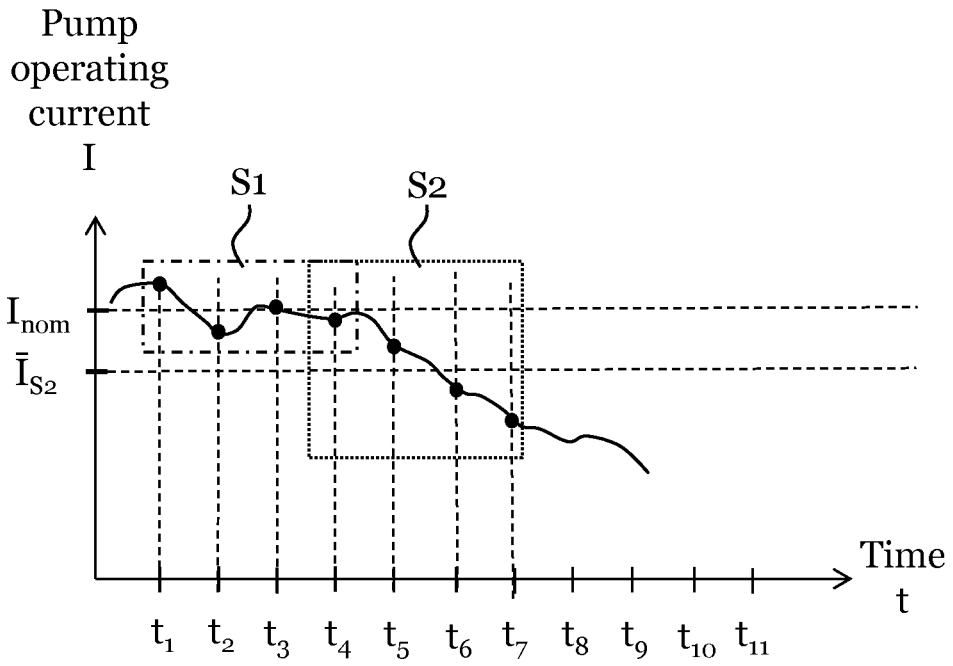
FIG. 6 illustrates a decrease in circulation pump operating current over time.

FIG. 6 illustrates another scenario, where initially, for the first set S1 of measured operating current values consisting of $I(t_1)$, $I(t_2)$, $I(t_3)$ and $I(t_4)$, it again can be concluded that $\bar{I}_{S1} \approx I_{nom}$.

However, for the second set S2 of measured operating current values consisting of $I(t_4)$, $I(t_5)$, $I(t_6)$ and $I(t_7)$, it can be seen that the average current $\bar{I}_{S2}$ is substantially lower, thereby reflecting a "true" decrease in pump torque (as indicated by the decreasing pump current), and thus process water flow through the circulation pump.

Figure 7:
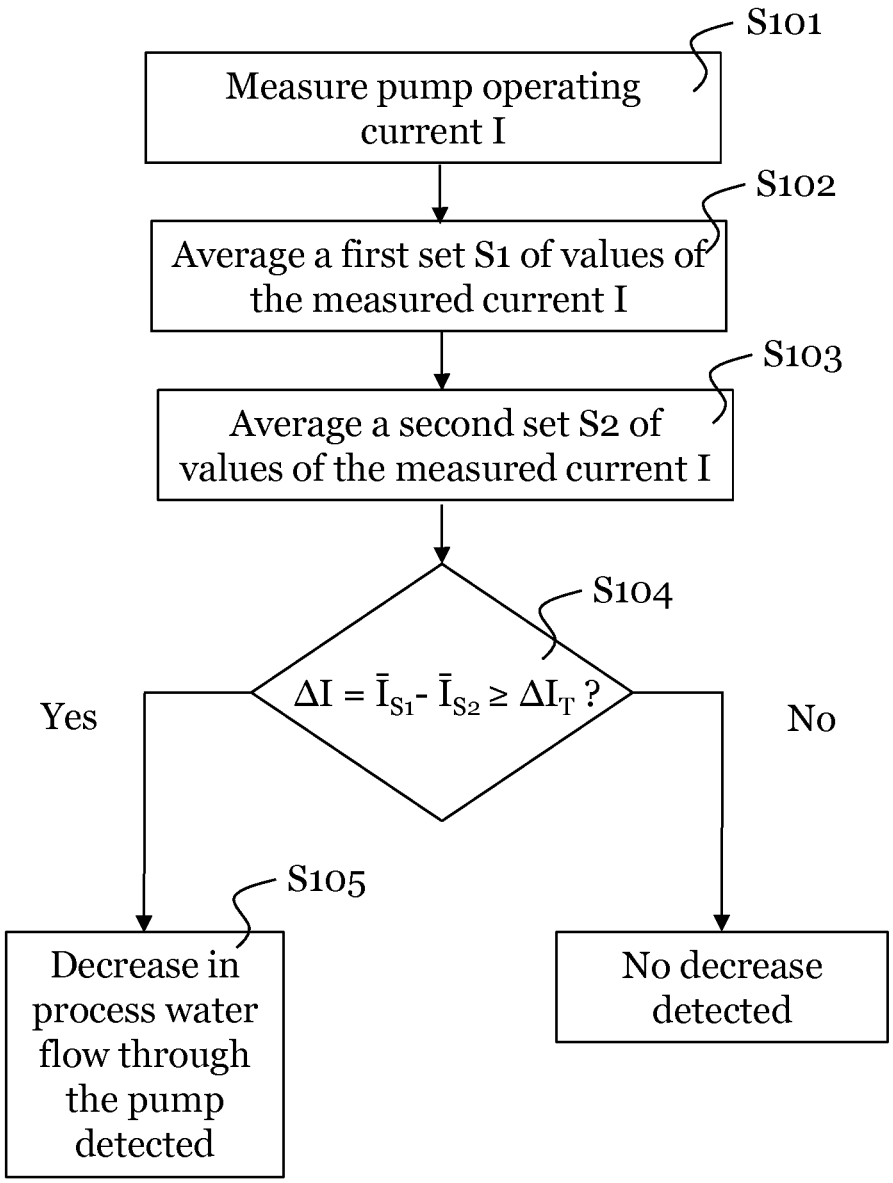
FIG. 7 shows a flowchart illustrating another embodiment of a method of detecting a change in process water flow of a circulation pump according to the invention.

Hence, with reference to the flowchart of FIG. 7, the operating current I of the circulation pump is measured in step S101 and a first and second average $\bar{I}_{S1}$, $\bar{I}_{S2}$ is created in steps S102 and S103, respectively.

In this particular embodiment, the comparing of the first average $\bar{I}_{S1}$ with the second average $\bar{I}_{S2}$ comprises calculating a difference between the first average and the at least one second average as $\Delta I=\bar{I}_{S1}-\bar{I}_{S2}$, and determining whether the difference exceeds a predetermined current threshold value $\Delta I_T$:

$$\Delta I=\bar{I}_{S1}-\bar{S}_{S2}\geq\Delta I_T.$$

If so, a decrease in pump torque is detected, and it is concluded in step S105 that a decrease in process water flow through the circulation pump indeed has occurred. A possible action to be taken by the processor 11 may be to control the valve 15 of the inlet 16 to supply additional water to the dishwasher 1.

Figure 8:
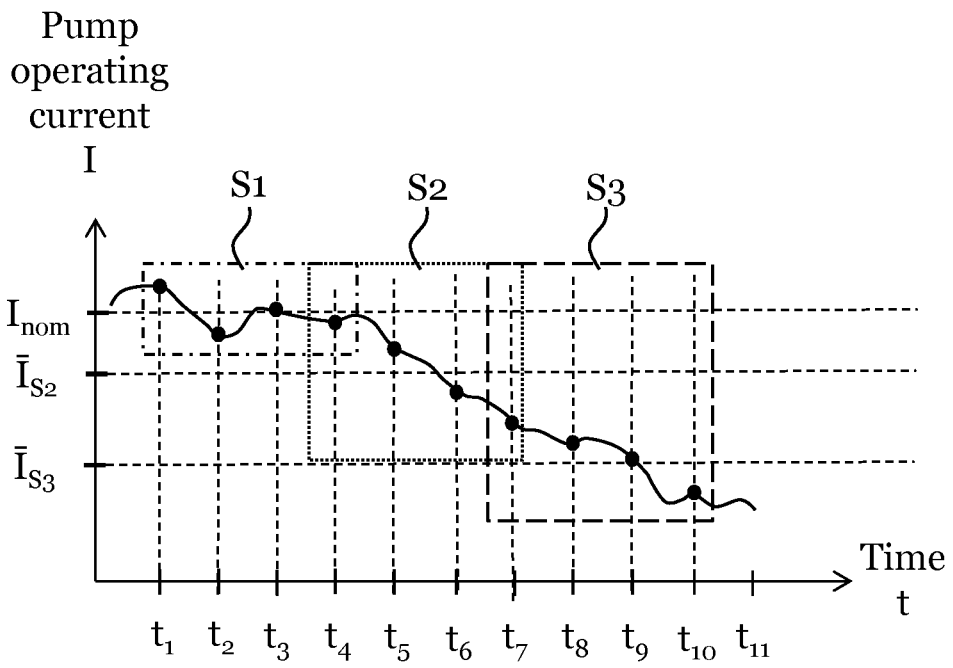
FIG. 8 illustrates further decrease in circulation pump operating current over time.

FIG. 8 illustrates the scenario of FIG. 6, but where a third set S3 of measured operating current values is taken into account for detecting process water flow change of the circulation pump.

Figure 9:
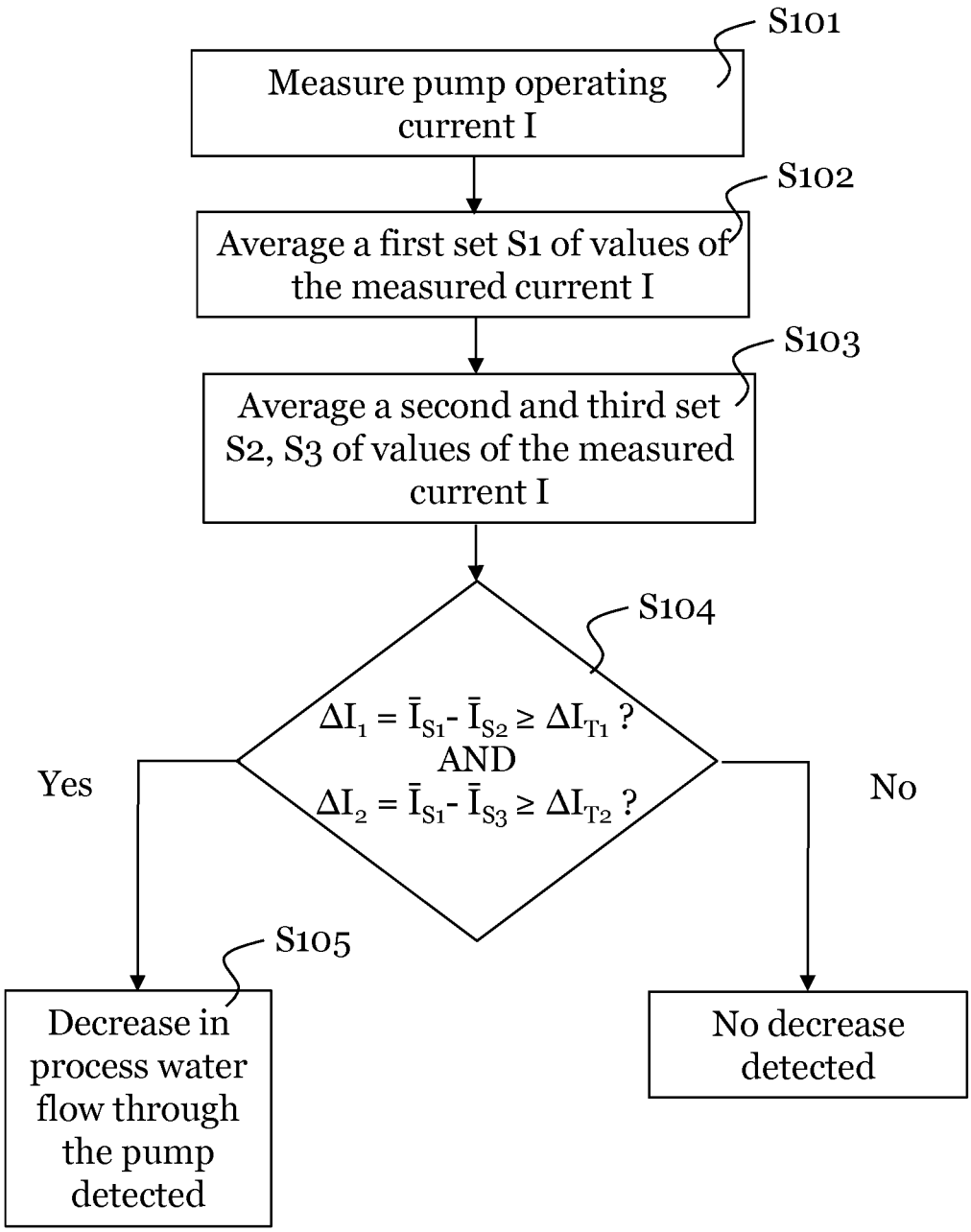
FIG. 9 shows a flowchart illustrating a further embodiment of a method of detecting a change in process water flow of a circulation pump according to the invention.

Hence, with reference to the flowchart of FIG. 9, the operating current I of the circulation pump is measured in step S101 and a first average $\bar{I}_{S1}$ is created in step S102.

Further, in this embodiment, a plurality of sets of current values are averaged in step S103, in this example a second set S2 and a third set S3, the third set S3 consisting of measured current values $I(t_7)$, $I(t_8)$, $I(t_9)$ and $I(t_{10})$.

For the third set S3 of measured operating current values, it can be seen that the average current $\bar{I}_{S3}$ is substantially lower as compared to $\bar{I}_{S1}$ (and even as compared to $\bar{I}_{S2}$), thereby even more strongly reflecting a true decrease in pump torque (as indicated by the decreasing pump current), and thus process water flow through the circulation pump, when compared to the embodiment described with reference to FIGS. 6 and 7.

In this particular embodiment, the comparing in step S104 of the first average $\bar{I}_{S1}$ with the second average $\bar{I}_{S2}$ comprises calculating a difference between the first average and the second average as $\Delta I_1=\bar{I}_{S1}-\bar{I}_{S2}$, and determining whether the difference exceeds a first predetermined current threshold value $\Delta I_{T1}$:

$$\Delta I_1=\bar{I}_{S1}-\bar{I}_{S2}\geq\Delta I_{T1}.$$

Further in step S104, the first average $\bar{I}_{S1}$ is compared with the third average $\bar{I}_{S3}$ by calculating a difference between the first average and the third average as $\Delta I_2=\bar{I}_{S1}-\bar{I}_{S3}$, and determining whether the difference exceeds a second predetermined current threshold value $\Delta I_{T2}$:

$$\Delta I_2=\bar{I}_{S1}-\bar{I}_{S3}\geq\Delta I_{T2}.$$

If both of theses conditions are fulfilled, a decrease in pump torque is detected, and it is concluded in step S105 that a decrease in process water flow through the circulation pump indeed has occurred. Again, a possible action to be taken by the processor 11 may be to control the valve 15 of the inlet 16 to supply additional water to the dishwasher 1.

Hence, in this particular example, if both averages $\bar{I}_{S2}$, $\bar{I}_{S3}$ differ from $\bar{I}_{S1}$ to a certain extent, a change is detected. In practice, averages of even further sets of measured current values may have to fulfil corresponding threshold conditions for a detection of flow rate change to occur.

Figure 10:
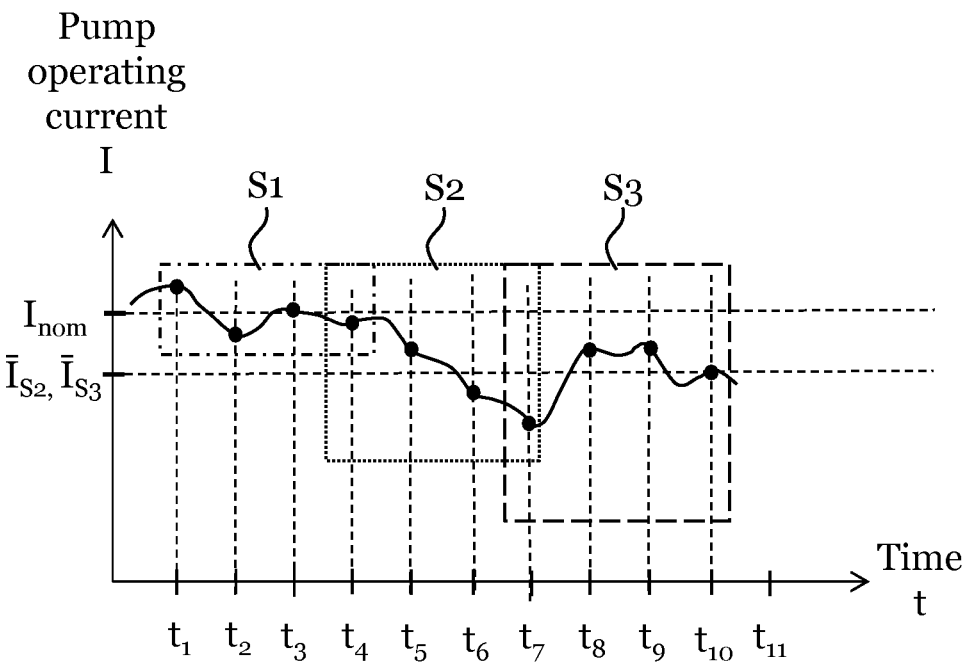
FIG. 10 illustrates a further scenario where circulation pump operating current decreases over time.

With reference to FIG. 10, it should be noted that the average current $\bar{I}_{S3}$ of the third set S3 not necessarily must be lower than that of the second set S2.

In FIG. 10, the third average $\bar{I}_{S3}$ is about the same as the second average $\bar{I}_{S2}$, which thus indicates that a true decrease in pump torque has occurred.

It may thus suffice in the comparing step S104 that $$\Delta I_1=\bar{I}_{S1}-\bar{I}_{S2}\geq\Delta I_T \text{ and } \Delta I_2=\bar{I}_{S1}-\bar{I}_{S3}\geq\Delta I_T,$$

i.e. that both differences in average current $\Delta I_1$, $\Delta I_2$ exceeds the same predetermined threshold value $\Delta I_{T1}$, for a decrease in flow should be detected in step S105. Again, if both averages $\bar{I}_{S2}$, $\bar{I}_{S3}$ differ from $\bar{I}_{S1}$ to a certain extent based on the threshold value SIT, a change is detected.

The figures illustrate decrease in process water flow, but an increase in process water flow would be detected analogously, with an increasing average pump current when comparing the first set S1 with at least one further set S2.

In practice, the steps of the method performed by the dishwasher 1 according to embodiments of the invention, is caused by the controller 11 embodied in the form of one or more microprocessors or processing units arranged to execute a computer program 12 downloaded to a suitable storage medium 13 associated with the microprocessor, such as a Random Access Memory (RAM), a Flash memory or a hard disk drive. The controller 11 is arranged to cause the dishwasher 1 to carry out at the steps of the method according to embodiments of the present invention when the appropriate computer program 12 comprising computer-executable instructions is downloaded to the storage medium 13 and executed by the controller 11. The storage medium 13 may also be a computer program product comprising the computer program 12. Alternatively, the computer program 12 may be transferred to the storage medium 13 by means of a suitable computer program product, such as a Digital Versatile Disc (DVD) or a memory stick. As a further alternative, the computer program 12 may be downloaded to the storage medium 13 over a network. The controller 11 may alternatively be embodied in the form of a digital signal processor (DSP), an application specific integrated circuit (ASIC), a field-programmable gate array (FPGA), a complex programmable logic device (CPLD), etc.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. Method of detecting a change in process water flow of a circulation pump in an appliance for washing and rinsing goods, comprising:

measuring a property indicating torque of the circulation pump;

averaging a first set of values of the measured property, thereby creating a first average;

averaging at least a further set of values of the measured property, thereby creating at least one further average;

comparing the first average with the at least one further average; and detecting the change in process water flow of the circulation pump based on a difference between the first average and the at least one further average.

2. The method of claim 1, wherein the comparing the first average with the at least one further average comprises:

calculating a difference between the first average and the at least one further average;

determining whether said difference complies with a predetermined threshold criterion; and if so:

detecting a decrease in process water flow of the circulation pump.

3. The method of claim 2, wherein the determining whether said difference complies with a predetermined threshold criterion comprises:

determining whether said difference exceeds a predetermined threshold value.

4. The method of claim 1, wherein the averaging of at least a further set of values of the measured property comprises:

averaging a plurality of sets of values of the measured property, thereby creating a corresponding plurality of averages; and wherein the comparing of the first average with the at least one further average comprises:

comparing the first average with each of said plurality of averages; and wherein the detecting of the change in process water flow comprises:

detecting the change in process water flow of the circulation pump based on differences between the first average and each of said plurality of averages.

5. The method of claim 4, wherein the comparing of the first average with the at least one further average comprises:

calculating a difference between the first average and each of the plurality averages;

determining whether each calculated difference complies with a predetermined threshold criterion; and if so:

detecting a decrease in process water flow of the circulation pump.

6. The method of claim 5, wherein the determining whether each calculated difference complies with a predetermined threshold criterion comprises:

determining whether each calculated difference exceeds a corresponding predetermined threshold value.

7. The method of claim 1, wherein averaging at least a further set of values of the measured property thereby creating at least one further average comprises creating a second further average and a third further average, wherein calculating a difference between the first average and the at least one further average comprises calculating a difference between the first average and the second further average and calculating a difference between the first average and the third further average, wherein detecting the change in process water flow of the circulation pump based on the difference between the first average and the at least one further average comprises detecting the change in process water flow of the circulation pump based on the difference between the first average and the at second further average and based on the difference between the first average and the third further average.

8. The method of claim 2, further comprising:

controlling a valve to supply additional water in response to detecting the decrease in process water flow of the circulation pump.

9. The method of claim 1, wherein measuring a property indicating torque of the circulation pump is performed in response to the circulation pump circulating process water to at least one wash arm.

10. A computer program comprising computer-executable instructions for causing a device to perform steps recited in claim 1 when the computer-executable instructions are executed on a processing unit included in the device.

11. A computer program product comprising a computer readable medium, the computer readable medium having the computer program according to claim 10 embodied thereon.

12. An appliance for washing and rinsing goods, comprising:

a circulation pump;

a sensing arrangement arranged to measure a property indicating torque of the circulation pump; and a controller arranged to:

average a first set of values of the measured property, thereby creating a first average;

average at least a further set of values of the measured property, thereby creating at least one further average;

compare the first average with the at least one further average; and detect change in process water flow of the circulation pump based on a difference between the first average and the at least one further average.

13. The appliance of claim 12, the controller further being arranged to, when comparing the first average with the at least one further average:

calculate a difference between the first average and the at least one further average;

determine whether said difference complies with a predetermined threshold criterion; and if so detect a decrease in process water flow of the circulation pump.

14. The appliance of claim 13, the controller further being arranged to, when determining whether said difference complies with a predetermined threshold criterion comprises:

determine whether said difference exceeds a predetermined threshold value.

15. The appliance of claim 12, the controller further being arranged to, when averaging at least a further set of values of the measured property:

average a plurality of sets of values of the measured property, thereby creating a corresponding plurality of averages; and being arranged to, when comparing the first average with the at least one further average:

compare the first average with each of said plurality of averages; and detect the change in process water flow of the circulation pump based on differences between the first average and each of said plurality of averages.

16. The appliance of claim 15, the controller further being arranged to, when comparing the first average with the at least one further average:

calculate a difference between the first average and each of the plurality averages;

determine whether each calculated difference complies with a predetermined threshold criterion; and if so detect a decrease in process water flow of the circulation pump.

17. The appliance of claim 16, the controller further being arranged to, when determining whether each calculated difference complies with a predetermined threshold criterion:

determine whether each calculated difference exceeds a corresponding predetermined threshold value.

18. The appliance of claim 12, the sensing arrangement being arranged to measure operating current of a motor driving the circulation pump in order to attain a representation of the property indicating torque of the circulation pump.

19. The appliance of claim 18, wherein the sensing arrangement comprises:

a resistor arranged at the motor driving the circulation pump, through which resistor operating current of the motor is measured, in order to attain the representation of the property indicating torque of the circulation pump.

20. The appliance of claim 12, further comprising:

a drain pump, wherein the circulation pump is configured to circulate process water through at least one wash arm during a wash cycle, wherein the drain pump is configured to drain water from the appliance during a drain cycle.

* * * * *